United States Patent [19]

Henderson

[11] 3,935,719

[45] Feb. 3, 1976

[54] RECIRCULATING

[75] Inventor: Raymond G. Henderson, Mount Prospect, Ill.

[73] Assignee: A-T-O Inc., Willoughby, Ohio

[22] Filed: Aug. 6, 1973

[21] Appl. No.: 386,014

[52] U.S. Cl. ..... 68/58; 68/184; 68/207; 68/208

[51] Int. Cl.[2] ..... D06F 39/02

[58] Field of Search ..... 68/184, 207, 208, 58, 15, 68/16

[56] References Cited

UNITED STATES PATENTS

| | | | |
|---|---|---|---|
| 1,002,635 | 9/1911 | Bratkowski | 68/207 |
| 1,487,907 | 3/1924 | Yates | 68/58 |
| 1,890,493 | 12/1932 | Bonsakios | 68/207 X |
| 2,023,013 | 12/1935 | Faber et al. | 68/16 UX |
| 2,514,050 | 7/1950 | Grebe | 68/207 X |
| 2,728,352 | 12/1955 | Sanders | 68/207 X |
| 2,764,722 | 9/1958 | McKeown | 68/207 UX |
| 2,914,935 | 12/1959 | Sampsel | 68/58 X |
| 2,972,876 | 2/1961 | Geldhof | 68/207 X |
| 3,091,109 | 5/1963 | Clement et al. | 68/15 X |
| 3,327,727 | 6/1964 | Anastasia | 68/207 X |
| 3,406,710 | 10/1968 | Voda | 68/207 X |

*Primary Examiner*—Harvey C. Hornsby
*Assistant Examiner*—C. K. Moore

[57] ABSTRACT

In combination with a washing machine of the type including a cylindrical drum mounted for rotation about the axis thereof and having a washing fluid inlet and a washing fluid outlet, a recirculating pump having an inlet and an outlet, a recirculating suction line extending from the washing machine outlet to the pump inlet, and a supply tank having an outlet, and a main inlet line extending from the pump outlet to the washing machine inlet, the supply tank outlet being connected to the suction line such that flow to the pump inlet from the washing machine will cause chemicals from the supply tank to be drawn into the pump and be mixed with flow from the pump to the main inlet line.

9 Claims, 1 Drawing Figure

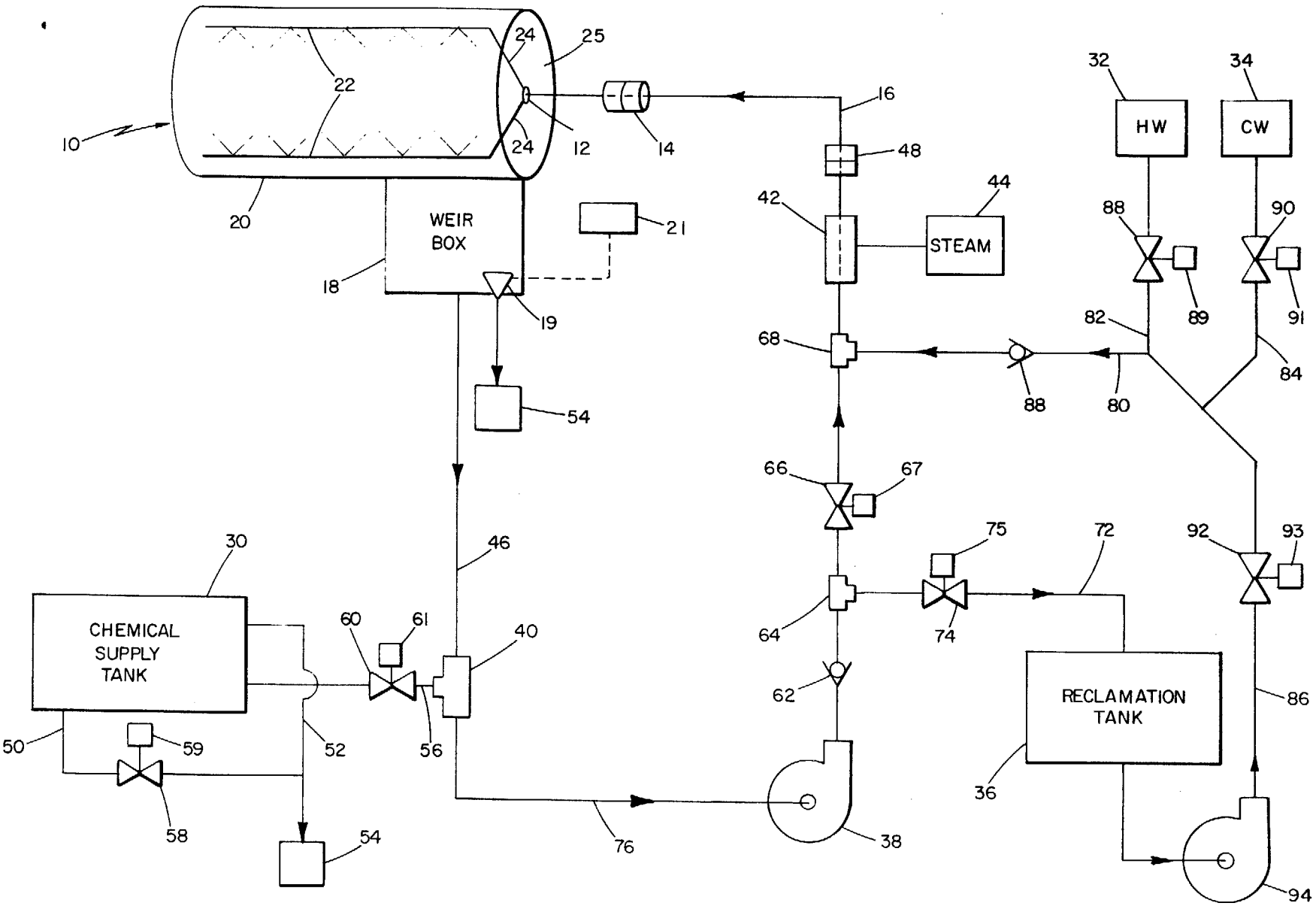
CW
HW
STEAM
RECLAMATION TANK
WEIR BOX
CHEMICAL SUPPLY TANK

RECIRCULATING

This invention relates to washing.

It is a primary object of the present invention to provide a recirculation system for use with commercial washing machines which makes possible shortening the normal wash cycle by a third. Other objects include providing such a system in which heating of the water is greatly facilitated, uniformity of chemical supply is insured, a supplemental spray wash is obtained and the need for a separate water reclamation storage pump is eliminated.

The invention features, in combination with a washing machine of the type including a cylindrical drum mounted for rotation about the axis thereof and having a washing fluid inlet and an outlet, a recirculating suction line extending from the washing machine outlet to the pump inlet, a supply tank having an outlet, and a main inlet line extending from the pump outlet to the washing machine inlet, the supply tank outlet being connected to the suction line such that flow from the pump inlet from the washing machine will cause chemicals from the supply tank to be drawn into the pump and be mixed with flow from the pump to the main inlet line. In preferred embodiments in which a steam ring heater surrounds the main inlet line for heating fluid prior to inlet into the washing machine, there is featured a reclamation tank having its inlet connected to the main inlet line downstream of the pump outlet, a supply line connected to each of a hot water source, a cold water source, and the outlet of the reclamation tank, control valves for controlling flow from, respectively, the supply tank and the sources, and to, respectively, the reclamation tank and the washing machine, and backflow valves for preventing backflow in the main inlet and supply lines.

Other objects, features, and advantages will appear from the following detailed description of a preferred embodiment of the invention, taken in conjunction with the attached drawing which is a schematic view of a recirculation system of the preferred embodiment.

Referring more particularly to the drawing, there is indicated a commercial washing machine, generally designated 10, having its inlet 12 connected, through a rotary joint 14, to an inlet line 16 and its outlet connected to a weir box 18. The construction of washing machine 10 is illustrated in greater detail in copending applications Ser. No. 242,432, filed Apr. 10, 1972, now U.S. Pat. No. 3,760,613, and Ser. No. 270,059, filed July 10, 1972 now U.S. Pat. No. 3,780,545, both assigned to the same assignee as the present application, which prior applications are hereby incorporated by reference, and will be here discussed but briefly.

Washing machine 10 includes a cylindrical wash drum 20 mounted for horizontal rotation about its axis, and a pair of radially opposed spray ribs 22 extending longitudinally along the drum inner wall. Supply ribs 24 on the end wall 25 of the drum adjacent rotary joint 14 connect the drum inlet to spray ribs 22. Rotary joint 14 permits rotation of drum 20 relative to inlet pipe 16.

The illustrated recirculation and supply system include a chemical supply tank 30, a hot water source 32, a cold water source 34, a reclamation tank 36, a pump 38 (typically 3hp, 180gpm at 30 ft. head) and a steam ring heater 42 connected to a steam source 44. A recirculation suction line 46 extends from an outlet of weir box 18 through T-coupling 40 to the inlet of pump 38; inlet line 16 connects the pump outlet to rotary joint 14, passing through steam ring heater 42 and a flexible connector 48. A dump valve 19 in the bottom of weir box 18 controlled by an operator 21 permits the weir box to be emptied into drain 54.

Supply tank 30, which is made of polyethylene and is open at its top to permit the chemicals used in the wash cycle to be deposited therein, includes a main drain line 50 and an overflow drain line 52, both connected to drain 54, and a supply line 56 connected to a side inlet of T-coupling 40. Valves 58 and 60 are, respectively, provided in lines 50 and 56 and controlled by operators 59, 61.

A check valve 62 arranged to prevent back flow, a T-coupling 64, a valve 66 controlled by an operator 67, and a T-coupling 68 are provided in inlet line 16 intermediate the outlet of pump 38 and steam ring heater 42. The side of T-coupling 64 is connected through line 72 to reclamation tank 36. Valve 74 in line 72 is controlled by operator 75.

A supply line 80 connects the side inlet of T-coupling 68 to lines 82, 84, 86 from, respectively, hot water source 32, cold water source 34, and reclamation tank 36. A check valve 88 is provided in line 80 to prevent backflow from line 16. Control valves, 88, 90, 92 are provided in lines 82, 84, 86, respectively, and are controlled by respective operators 89, 91, 93. A reclamation water supply pump 94 is provided in line 86 between the outlet of tank 36 and control valve 92.

In operation, flow through each of lines 16, 56, 72, 82, 84, and 86, and through dump valve 19 is controlled (automatically, remotely or manually as desired) by operators 67, 61, 89, 91, 93 and 21, respectively. At the start of the first wash cycle, operators 89 and 91 open valves 88, 90, and hot and cold water sources 32, 34 is passed through supply line 80 and steam ring 42 to machine inlet 12. If desired, steam from source 48 may be applied to ring 42 during initial inlet to heat the filling water to the desired temperature. The water then flows into ribs 22 and is sprayed onto laundry in drum 20. As soon as the water has accumulated to a sufficient level, pump 38 draws water from weir box 18 through line 46. The suction flow into the pump draws chemicals from supply tank through line 56 (operator 61 having opened valve 60) into line 46, where they are mixed with the flow therethrough. The mixture is drawn into the pump inlet and forced through the pump into line 16. The chemical flow into injector 40 from supply tank 30 can be varied as desired by adjusting valve 60.

After the machine has been filled to the desired level, the valves 88, 90 controlling flow from the hot and cold water sources are closed. Valve 60 is closed when the desired volume of chemicals have been injected. Pump 38 continuously recirculates the wash water, in which the wash chemicals have been thoroughly mixed.

For rinsing, drum 20 is first drained either by actuating operator 21 to open dump valve 19 in weir box 18 to drain drum 20, or, if the wash water is to be released, by closing valve 66 to divert the flow from the outlet pump 38 into reclamation tank 36. Rinse water is then introduced into the drum from sources 32, 34 as described above.

It will be seen that wash water in reclamation tank 36 can be reused in a later wash cycle by introducing it through lines 86, 80 and 16 into machine 10. Steam source 44 and ring 42 quickly and efficiently heat all liquid introduced into drum 20 to the desired level, the various valves provided make it possible to control flow to and from drum 20 and tank 36, from sources 32, 34 tank 30 and weir box 18, and to drain 54 as desired; and the arrangement of the heating and chemical systems make it possible to combine steps in and reduce the overall time of the wash cycle.

Other embodiments within the scope of the following claims will occur to those skilled in the art.

What is claimed is:

1. In combination with a washing machine of the type including a cylindrical drum having a central axis, mounted for rotation about said axis, and having a washing fluid inlet and a washing fluid outlet:

a recirculating pump having an inlet and an outlet;

a recirculating suction line extending from the washing machine outlet to the pump inlet;

a main inlet line extending from the pump outlet to the washing machine inlet;

a chemical supply tank having an outlet connected to said suction line such that flow to the pump inlet from the washing machine outlet will cause chemicals from said supply tank to be drawn into said pump and be thoroughly mixed with flow from said pump passing to said main inlet line;

a steam heater connected to said main inlet line intermediate said pump outlet and said washing machine inlet, adapted for connection to a steam source, and arranged for heating fluid in said main inlet line during flow of said fluid from said pump to said washing machine; and, a water supply line connected to said main inlet line intermediate said pump outlet and said steam heater and adapted for connection to a water source.

2. The combination of claim 1 wherein said supply line is adapted for connection to each of a hot water source and a cold water source, and including an adjustable valve for controlling flow from each of said sources and a check valve in said supply line for preventing back flow from said main inlet line to either of said sources.

3. In combination with a washing machine of the type including a cylindrical drum having a central axis, mounted for rotation about said axis, and having a washing fluid inlet and a washing fluid outlet:

a recirculating pump having an inlet and an outlet;

a recirculating suction line extending from the washing machine outlet to the pump inlet;

a chemical supply tank having an outlet;

a main inlet line extending from the pump outlet to the washing machine inlet;

a steam heater connected to said main inlet line intermediate said pump outlet and said washing machine inlet; and, a reclamation by-pass line connected to said main inlet intermediate said pump and said heater and adapted for connection to the inlet of a reclamation tank whereby flow from said pump may be directed to said reclamation tank;

a supply line connected to said main inlet line intermediate the connection points of said by-pass line and said heater and adapted for connection to the outlet of said reclamation tank whereby fluid in said tank may be directed into said main inlet line and thence past said heater and into said washing machine; and, a check valve in said main inlet line intermediate said connection point of said by-pass line and said pump and arranged for preventing back flow therethrough said pump, said supply tank outlet being connected to said suction line such that flow to the pump inlet from the washing machine outlet will cause chemicals from supply tank to be drawn into said pump and be thoroughly mixed with flow from said pump passing to said main inlet, and said heater being adapted for connection to a steam source and being arranged for heating fluid in said main inlet line during flow of said fluid from said pump to said washing machine.

4. The combination of claim 1 including a control valve intermediate said supply tank and said suction line for controlling flow of chemicals from said supply tank, and a back-flow control valve in said main inlet line intermediate said pump and the point of connection of said supply line to said main inlet line for preventing flow through said main inlet line toward said pump; and,

5. In combination with a washing machine of the type including a cylindrical drum having a central axis, mounted for rotation about said axis, and having a washing fluid inlet and a washing fluid outlet:

a recirculating pump having an inlet and an outlet;

a recirculating suction line extending from the washing machine outlet to the pump inlet;

a supply tank having an outlet, said supply tank outlet being connected to said suction line such that flow to the pump inlet from the washing machine outlet will cause chemicals from said supply tank to be drawn into said pump and be thoroughly mixed with flow from said pump passing to said main inlet line;

a main inlet line extending from the pump outlet to the washing machine inlet;

a control valve intermediate said supply tank and said suction line for controlling flow of chemicals from said supply tank;

a supply line connected to said main inlet line intermediate said washing machine and said pump, said supply line being adapted for connection to a source of fluid;

a heater adjacent said main inlet line intermediate said washing machine and the point of connection of said supply line to said main inlet line and arranged to heat fluid in said main inlet line;

a back-flow control valve in said main inlet line intermediate said pump and said point of connection for preventing flow therethrough toward said pump;

a reclamation by-pass line connected to said main inlet line intermediate said pump and said point of connection of said supply line and adapted for connection to the inlet of a reclamation tank whereby flow from said pump may be directed to said reclamation tank;

a main flow control valve in said main inlet line intermediate said points of connection of said inlet line and said by-pass line; and, a reclamation control valve in said by-pass line for controlling flow therein, said supply line being adapted for connection to the outlet of said reclamation tank.

6. The combination of claim 5 wherein said supply line is adapted for connection to each of said outlet of said reclamation tank, a hot water source, and a cold water source, and including respective inlet control valves for controlling flow from said reclamation tank and said sources through said supply line to said washing machine, and a backflow control valve in said supply line intermediate said point of connection of said supply line and said control valves for preventing backflow in said supply line, and a pump for causing flow from said reclamation tank.

7. The combination of claim 6 wherein said heater is a steam ring heater adapted for connection to a source of steam and surrounding said main inlet line.

8. The combination of claim 7 wherein said supply tank includes an overflow outlet and a drain outlet, said washing machine includes a drain outlet, and including drain control valve for controlling flow through each of said drain outlets.

9. The combination of claim 1 wherein said heater is a steam ring heater.

* * * * *